US010205546B2

(12) United States Patent
Hartmann et al.

(10) Patent No.: US 10,205,546 B2
(45) Date of Patent: Feb. 12, 2019

(54) METHOD FOR OPERATING A RADIO SYSTEM, RADIO SYSTEM AND MOTOR VEHICLE HAVING A RADIO STATION

(71) Applicant: Audi AG, Ingolstadt (DE)

(72) Inventors: Jürgen Hartmann, Gutenstetten (DE); Patrick Sassmannshausen, Boehmfeld (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 15/552,204

(22) PCT Filed: Jan. 14, 2016

(86) PCT No.: PCT/EP2016/000062

§ 371 (c)(1),
(2) Date: Aug. 18, 2017

(87) PCT Pub. No.: WO2016/131520

PCT Pub. Date: Aug. 25, 2016

(65) Prior Publication Data

US 2018/0041297 A1 Feb. 8, 2018

(30) Foreign Application Priority Data

Feb. 21, 2015 (DE) ..... 10 2015 002 245

(51) Int. Cl.
*H04H 60/70* (2008.01)
*H04H 60/51* (2008.01)

(52) U.S. Cl.
CPC ..... *H04H 60/70* (2013.01); *H04H 60/51* (2013.01)

(58) Field of Classification Search
CPC ..... H04H 60/70; H04H 60/51
(Continued)

(56) References Cited

U.S. PATENT DOCUMENTS 5,097,507 A * 3/1992 Zinser ..... G10L 19/005 704/226
5,379,451 A * 1/1995 Nakagoshi ..... H04W 60/00 455/435.1

(Continued)

FOREIGN PATENT DOCUMENTS

DE 19839378 A1 3/2000
DE 102012000885 A1 8/2012

(Continued)

OTHER PUBLICATIONS

English-language abstract of German Patent Application Publication No. 198 39 378 A1, published Mar. 9, 2000; 1 page.

(Continued)

*Primary Examiner* — Hai V Nguyen
(74) *Attorney, Agent, or Firm* — Sterne, Kessler, Goldstein & Fox P.L.L.C.

(57) ABSTRACT

The invention relates to a method for operating a radio system of a motor vehicle. In one embodiment, the method comprises: specifying an area surrounding the motor vehicle, determining which digital radio stations within this area can be received error-free using a receiving device of the radio system, and displaying only those digital radio stations which can be received error-free within this area. The invention furthermore relates to a radio system for a motor vehicle and to a motor vehicle with a radio system.

17 Claims, 1 Drawing Sheet

(58) Field of Classification Search
USPC ..... 455/3.06; 340/4.37, 4.4; 381/77–85
See application file for complete search history.

(56) References Cited

U.S. PATENT DOCUMENTS 6,026,277 A * 2/2000 Gavrilovich ..... H04B 7/1555 455/11.1
6,169,896 B1 * 1/2001 Sant ..... H04W 24/00 379/9
6,181,921 B1 1/2001 Konisi et al.
6,345,186 B1 * 2/2002 Schultz ..... H04W 36/24 455/436
7,127,376 B2 * 10/2006 Nashner ..... A61B 5/1036 702/185
7,257,405 B2 * 8/2007 Yamato ..... G08G 1/096716 455/404.2
7,653,347 B2 * 1/2010 Klotsche ..... H04W 56/0035 455/10
7,974,338 B2 * 7/2011 Becker ..... H04H 40/00 360/53
8,131,235 B2 * 3/2012 Becker ..... H03J 1/0083 455/150.1
8,254,928 B2 * 8/2012 Watanabe ..... H04W 36/30 455/414.1
8,312,660 B1 * 11/2012 Fujisaki ..... F41A 17/08 42/70.01
8,374,594 B2 * 2/2013 Yamato ..... G08G 1/096716 455/422.1
8,542,631 B2 * 9/2013 Iseda ..... H04W 88/04 370/252
8,565,687 B2 * 10/2013 Dickey ..... H01Q 1/125 342/449
8,584,388 B1 * 11/2013 Fujisaki ..... F41A 17/08 42/70.01
8,676,273 B1 * 3/2014 Fujisaki ..... H04M 1/6505 455/567
8,831,547 B2 * 9/2014 Becker ..... H01Q 21/30 455/132
8,885,039 B2 * 11/2014 Jang ..... G01C 21/36 340/436
9,031,499 B2 5/2015 Pandey et al.
9,112,578 B2 * 8/2015 Wise ..... H04B 7/18513
9,147,937 B2 * 9/2015 Becker ..... H04B 1/0064
9,374,117 B2 * 6/2016 Gierl ..... H04B 1/1676
9,438,359 B2 * 9/2016 Haslam ..... H04H 20/20
9,467,255 B2 * 10/2016 Milbar ..... H04L 1/08
9,654,321 B2 * 5/2017 Becker ..... H04B 7/08
9,742,312 B2 * 8/2017 Domurat-Linde ... H05K 7/1432
9,767,693 B2 * 9/2017 Lee ..... G08G 1/166
2001/0034239 A1 * 10/2001 Yamato ..... G08G 1/096716 455/456.6
2003/0040272 A1 * 2/2003 Lelievre ..... H04H 20/26 455/3.06
2004/0064250 A1 * 4/2004 Hirano ..... G01C 21/3614 701/410
2004/0090950 A1 * 5/2004 Lauber ..... H04Q 9/00 370/352
2004/0127337 A1 * 7/2004 Nashner ..... A61B 5/1036 482/100
2005/0075833 A1 * 4/2005 Nashner ..... A61B 5/1036 702/179
2006/0080033 A1 * 4/2006 Komatsu ..... G01C 21/30 701/448
2006/0195239 A1 * 8/2006 Teichner ..... H04H 20/26 701/36
2007/0067415 A1 * 3/2007 Kawaguchi ..... G01C 21/3697 709/217
2007/0091194 A1 * 4/2007 Kwak ..... H04N 5/23293 348/333.01
2007/0093989 A1 * 4/2007 Nashner ..... A61B 5/1036 702/185
2007/0129072 A1 * 6/2007 Yamato ..... G08G 1/096716 455/422.1
2007/0197165 A1 * 8/2007 Klotsche ..... H04W 56/0035 455/63.1
2007/0213038 A1 * 9/2007 Masseroni ..... H04L 29/06027 455/414.3
2007/0291693 A1 * 12/2007 Schultz ..... H04W 28/18 370/331
2008/0144710 A1 * 6/2008 Becker ..... H04H 40/00 375/240
2008/0299926 A1 * 12/2008 Becker ..... H03J 1/0083 455/179.1
2009/0005969 A1 * 1/2009 Tamura ..... G01C 21/3423 701/533
2009/0104911 A1 * 4/2009 Watanabe ..... H04W 36/30 455/436
2009/0117905 A1 * 5/2009 Watanabe ..... H04W 48/20 455/437
2009/0201859 A1 * 8/2009 Iseda ..... H04W 88/04 370/328
2009/0219900 A1 * 9/2009 Kokkinen ..... B61L 15/0027 370/338
2010/0010648 A1 * 1/2010 Bull ..... G06F 17/30058 700/94
2010/0020169 A1 * 1/2010 Jang ..... G01C 21/36 348/115
2010/0233980 A1 * 9/2010 Uppala ..... H03J 1/0075 455/185.1
2010/0234071 A1 * 9/2010 Shabtay ..... H04B 7/0408 455/562.1
2010/0256905 A1 * 10/2010 Hilbrandie ..... G01C 21/26 701/469
2011/0144911 A1 * 6/2011 Madhavan ..... G01C 21/00 701/472
2011/0228047 A1 * 9/2011 Markham ..... H04N 13/221 348/43
2012/0108192 A1 * 5/2012 Dickey ..... H01Q 1/125 455/269
2012/0225681 A1 * 9/2012 Hung ..... H04W 84/005 455/507
2012/0253670 A1 * 10/2012 Nagda ..... G01C 21/26 701/500
2012/0322434 A1 * 12/2012 Samuel ..... H04B 1/205 455/418
2013/0028425 A1 * 1/2013 Gierl ..... H04B 1/1676 381/22
2013/0078945 A1 * 3/2013 Lavi ..... H04W 84/22 455/410
2013/0097269 A1 * 4/2013 Plotkin ..... H04L 51/02 709/206
2013/0162559 A1 * 6/2013 Hayatoma ..... G06F 3/041 345/173
2013/0162563 A1 * 6/2013 Matsuoka ..... G06F 3/041 345/173
2013/0176401 A1 * 7/2013 Monari ..... H04N 5/2252 348/47
2013/0187875 A1 * 7/2013 Matsuoka ..... G06F 3/041 345/173
2013/0288618 A1 * 10/2013 Becker ..... H01Q 21/30 455/90.2
2013/0288632 A1 * 10/2013 Becker ..... H01Q 21/30 455/278.1
2013/0343332 A1 * 12/2013 Yao ..... H04B 7/022 370/329
2014/0019005 A1 * 1/2014 Lee ..... G08G 1/166 701/36
2014/0028527 A1 * 1/2014 Becker ..... H04B 1/0064 343/894
2014/0140353 A1 * 5/2014 Stahlin ..... H04L 45/3065 370/419
2014/0171088 A1 * 6/2014 Edara ..... H04W 36/32 455/440
2014/0192708 A1 * 7/2014 Wise ..... H04B 7/18513 370/316
2015/0245280 A1 * 8/2015 Zhou ..... H04W 36/32 455/434
2015/0343947 A1 * 12/2015 Bernico ..... B60Q 9/00 340/436

(56) References Cited

U.S. PATENT DOCUMENTS

| | | | | |
|---|---|---|---|---|
| 2016/0094150 | A1* | 3/2016 | Domurat-Linde | H01L 25/072 318/503 |
| 2016/0182192 | A1* | 6/2016 | Milbar | H04L 1/08 714/748 |
| 2016/0211995 | A1* | 7/2016 | Becker | H04B 7/08 |
| 2016/0236692 | A1* | 8/2016 | Kleen | B42D 9/004 |
| 2016/0360537 | A1* | 12/2016 | Palenius | H04W 48/08 |
| 2017/0019215 | A1* | 1/2017 | Milbar | H04L 1/08 |
| 2017/0032402 | A1* | 2/2017 | Patsiokas | G06Q 30/0266 |
| 2017/0352277 | A1* | 12/2017 | Lee | G08G 1/166 |

FOREIGN PATENT DOCUMENTS

| | | | |
|---|---|---|---|
| DE | 102011116637 | A1 | 4/2013 |
| DE | 102012204090 | A1 | 9/2013 |
| DE | 102013006125 | A1 | 10/2014 |
| EP | 0661522 | A1 | 7/1995 |
| EP | 1049277 | A2 | 11/2000 |
| EP | 1659711 | A1 | 5/2006 |
| EP | 2819330 | A1 | 12/2014 |

OTHER PUBLICATIONS

English-language abstract of German Patent Application Publication No. 10 2012 000 885 A1, published Aug. 2, 2012; 1 page.

English-language abstract of German Patent Application Publication No. 10 2012 204 090 A1, published Sep. 19, 2013; 1 page.

English-language abstract of German Patent Application Publication No. 10 2013 006 125 A1, published Oct. 16, 2014; 1 page.

International Search Report and Written Opinion of the International Searching Authority directed to related International Patent Application No. PCT/EP2016/000062, dated Apr. 18, 2016, with attached English-language translation; 24 pages.

International Preliminary Report on Patentability directed to related International Patent Application No. PCT/EP2016/000062, dated May 29, 2017, with attached English-language translation; 14 pages.

* cited by examiner

METHOD FOR OPERATING A RADIO SYSTEM, RADIO SYSTEM AND MOTOR VEHICLE HAVING A RADIO STATION

TECHNICAL FIELD

The invention relates to a method for operating a radio system of a motor vehicle, a radio system for a motor vehicle, and a motor vehicle with a radio system.

BACKGROUND

It is generally known that radio systems that are capable of receiving digitally broadcast radio programs can be used in motor vehicles. For this purpose, radio systems of this kind have a receiving device in the form of a so-called DAB receiver, where the acronym DAB stands for digital audio broadcasting, which is a digital transmission standard for terrestrial reception of digital radio. Usually, a channel overview shows which digital radio programs can currently be received in the vehicle. In addition, whether the station is currently being received or not is usually shown.

If a vehicle occupant selects a digital radio station which is currently available, this does not mean that the digital radio station will still be received in the following few seconds or minutes. It is a frequent occurrence during trips with a motor vehicle that it is traveling at a reception limit for the reception of the corresponding digital radio stations, with the result being that there can be a constant alternation between an actual reception and muting since the previously selected digital radio station cannot currently be received. This switching back and forth is extremely annoying for vehicle occupants. This is particularly noticeable with digital radio since here the switch between an actual reception and a non-reception is abrupt, in contrast to analog radio where the reception quality deteriorates slowly.

DE 102013006125 A1 discloses a method for operating a receiving device of a motor vehicle. As soon as a route has been set in the navigation system of the motor vehicle, the receiving device is notified in advance of future shadow areas where certain radio stations cannot be received. Depending on the specified route and the known shadow areas, various radio stations are temporarily buffered in a memory facility. As soon as the motor vehicle passes into one of the shadow areas in which no radio reception is possible, the previously buffered data is played back.

DE 102012000885 A1 discloses a method for setting radio stations in a vehicle radio system. Here, a number of radio stations are displayed which are broadcast along a route planned by a driver.

DE 102012204090 A1 discloses a radio receiver with an automatic reaction to radio reception interferences. As soon as a motor vehicle enters a tunnel where a previously set radio station can no longer be received, the radio automatically switches to a radio station that can be received in the tunnel.

DETAILED DESCRIPTION

Figure 1:
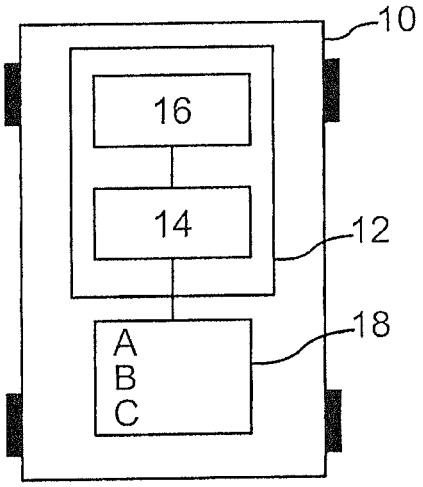
FIG. 1 shows a schematic representation of a motor vehicle that has a radio system for receiving digital radio stations.

It is the task of the present invention to provide a solution which makes it possible to listen to digital radio stations within a motor vehicle with as few interruptions as possible.

This task is solved by a method for operating a radio system, by a radio system and by a motor vehicle with a radio system with the features of the independent patent claims. Advantageous embodiments having useful and non-trivial further developments of the invention are indicated in the dependent claims.

In the method according to the invention for operating a radio system of a motor vehicle, an area surrounding the motor vehicle is specified. It is determined which digital radio stations within this area can be received error-free using a receiving device of the radio system. Only those digital radio stations which can be received error-free within this area are displayed. In other words, the area surrounding the motor vehicle is a predefined surrounding area of the motor vehicle which, as the motor vehicle travels, moves with it at the speed of the motor vehicle. If, for example, the motor vehicle is located centrally in the predefined area, it can, for example, be provided that, as the motor vehicle travels, this area is constantly moved in such a way that the positioning of the motor vehicle within the area always remains the same.

In the method according to the invention, the display of the digital radio stations does not depend on whether the digital radio stations concerned can currently be received but is rather based on a geographical assessment. Here the current location of the motor vehicle is evaluated to see whether a digital radio reception of the respective digital radio stations will be possible around this location within the predefined area, in other words, in a closer environment of the motor vehicle. Only those digital radio stations that can be received error-free within this area are actually displayed, for example, in a selection menu. In this way, it can be ensured that a vehicle occupant can only select from those digital radio stations that he can also receive error-free and reliably over, for example, the next few minutes. The occupants of the motor vehicle are thus not negatively affected by a constant switching back and forth between a functioning digital radio reception and muting.

One advantageous embodiment of the invention provides for a file, in particular a digital receiver card, being provided which holds information as to which digital radio stations can be received error-free depending on the location, wherein the use of the file enables determination of which digital radio stations can be received error-free in the predefined area. This file can, for example, be stored in the motor vehicle within a memory facility. Alternatively, it is also possible to access this file on-line, said file being stored on a server outside the motor vehicle. In other words, it is thus also possible as an alternative for a connection to be set up, preferably wirelessly, between the off-board server and the motor vehicle's radio system, thus allowing access to the file in question. However, this file is preferably stored in the vehicle. It can be provided here that an updating of the file is carried out at specified time intervals, for example, by a wireless connection being set up between the off-board server and the radio system, thereby enabling an updating of the file. Updating this file brings with it in particular the benefit that, for example, weather-dependent changes with respect to digital radio reception or even, for example, a change in the distribution of transmitting stations which broadcast digital radio stations can be taken into account.

A further advantageous embodiment of the invention provides for the file being updated at predefined intervals on the basis of data provided by other motor vehicles regarding a location-dependent reception quality of the digital radio stations. These motor vehicles can, for example, capture the corresponding digital reception qualities regarding the digital radio stations in question and transmit them wirelessly to an off-board server. The aforementioned file is preferably also stored on this off-board server, said file being updated on the basis of data transmitted by the relevant motor vehicles regarding the reception quality of the digital radio stations. During operation of the radio system of the motor vehicle, the file can then be continuously updated in turn by establishing a wireless connection between the off-board server and the radio system. In this way, particularly current and reliable data regarding the location-dependent reception quality of the digital radio stations can be provided so that it can also be particularly reliably determined which digital radio stations can be received error-free within the given area by the receiving device of the radio system.

Another advantageous embodiment of the invention provides that the faster the motor vehicle is traveling, the larger the area will be set. If the motor vehicle is, for example, traveling at 80 to 100 km/h on an ordinary highway, a smaller area is selected, in particular in the direction in which the vehicle is traveling, than when the vehicle is traveling on a freeway at 130 to 150 km/h, for example. In this way, it can be ensured that it can always be speed-dependently determined in advance for a corresponding period of time which digital radio stations will still be receivable in the future while the motor vehicle is traveling.

Another advantageous embodiment of the invention provides that if a navigation route is specified for the motor vehicle, the area will be specified in such a way that the area covers at least part of the navigation route. In particular, if a navigation route of the motor vehicle has been specified, for example, by the driver of the motor vehicle inputting a corresponding destination, the area can be restricted particularly usefully since it is very probable that the motor vehicle will be following only the navigation route anyway. In this regard, a continuous check is also only carried out along the navigation route or at least a part of the navigation routes as to which digital radio stations will generally be receivable, wherein only those receivable radio stations that lie within the specified area, for example, along a section of the navigation route, will be displayed for selection.

Another advantageous embodiment of the invention provides that if no navigation route of the motor vehicle has been specified, a likely route is determined depending on the time of day and/or depending on the day of the week, in other words depending on whether it is a weekday, a holiday or the like, and also taking into account the routes previously taken with the motor vehicle, and the area is specified in such a way that it covers at least part of the route. In other words, a direction of travel of the motor vehicle is thus determined taking into account the time of day and the relevant day of the week and also taking into account the routes previously traveled by the motor vehicle at the corresponding times and days. For example, it may be the case that the driver of the motor vehicle takes a route to his workplace each morning from Monday to Friday at roughly the same time. Knowing this route, which is always taken at these times, the area is specified in such a way that the area covers at least part of this predefined route. In other words, on the basis of historical data, it is thus estimated which route the driver of the motor vehicle will very probably take, wherein the corresponding area is defined as a function of this information. This makes it possible to determine very reliably for a route very probably to be taken by the driver which digital radio stations will be receivable along this route so that only these digital radio stations will be displayed for selection.

Another advantageous embodiment of the invention provides that the size and the shape of the area are specified as a function of the type of road currently being traveled by the motor vehicle. If, for example, the motor vehicle were to travel on a freeway and if the section being traveled has no freeway exits, it makes sense to restrict the area to a relatively narrow tube which essentially corresponds to the freeway currently being traveled. If, on the other hand, the motor vehicle is, for example, driving on a highway that has a large number of junctions and possible turn-offs, the area will, if applicable, be selected to be somewhat more extensive, in particular also transversely with respect to the current direction of travel, so that an area as large as possible is covered in order to anticipate possible turn-offs and thus make it possible to determine particularly reliably which digital radio stations will in the future still be receivable error-free, so that only these digital radio stations will be displayed for selection.

Another advantageous embodiment of the invention provides that the size and the shape of the area are specified as a function of a predefined uninterrupted minimum reception duration of the digital radio stations. For example, a selection menu can be provided by means of the radio system, by means of which selection menu the driver of the motor vehicle can choose how long he wants at least an error-free playback of the digital radio station in question. If he wants an especially long error-free minimum reception duration and playback duration, the area will be selected as correspondingly larger than when the driver does not want an especially long minimum reception duration and error-free playback duration. In addition, only those digital radio stations are preferably displayed which have the predefined minimum reception duration. In addition, it can also be provided that the driver of the motor vehicle can specify via the corresponding selection menu that he does not want an especially long minimum reception duration but rather to have a particularly high number of digital radio stations displayed. With such a requirement, it can be provided that the area be selected to be smaller than when a particularly long minimum reception duration is desired. In this case, it is possible that, when an especially large number of radio stations is to be displayed, the corresponding minimum reception duration for the digital radio stations is automatically reduced so that a larger selection or number of digital radio stations is displayed.

The radio system according to the invention for a motor vehicle includes a control device that is designed to specify an area surrounding the motor vehicle and to determine which digital radio stations within this area can be received error-free by means of a receiving device of the radio system and to control a display device of the motor vehicle in such a way that only those digital radio stations are displayed that can be received error-free within this area.

Advantageous developments of the method according to the invention are to be regarded as advantageous developments of the radio system according to the invention, wherein the radio system has in particular the means for executing the steps of the method.

The motor vehicle according to the invention includes the radio system according to the invention or an advantageous embodiment of the radio system according to the invention.

Further advantages, features, and details of the invention arise from the following description of advantageous exemplary embodiments, as well as with reference to the drawing. The features and feature combinations mentioned above in the description, as well as the features and feature combinations mentioned below in the description of the drawing and/or mentioned only in the figures, can be used in the specified combination but also in other combinations or alone without having to go beyond the scope of the invention.

Exemplary embodiments of the invention are described in the following with reference to the drawing.

Figure 2:
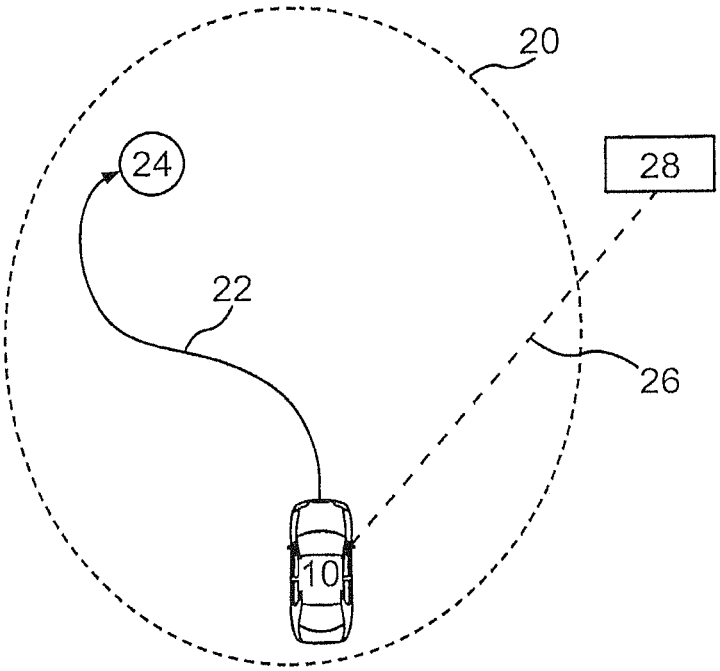
FIG. 2 shows a schematic illustration of the motor vehicle, wherein an area surrounding the motor vehicle is schematically depicted and a wireless connection between the motor vehicle and an off-board server is schematically depicted.

The drawings show:

FIG. 1 a schematic representation of a motor vehicle that has a radio system for receiving digital radio stations; and FIG. 2 a further schematic illustration of the motor vehicle, wherein an area surrounding the motor vehicle is schematically depicted and a wireless connection between the motor vehicle and an off-board server is schematically depicted.

In the figures, the same or functionally equivalent elements are provided with the same reference characters.

A motor vehicle 10 with a radio system 12 is shown in a schematic representation in FIG. 1. The radio system 12 comprises a control device 14 and a receiving device 16, which is designed to receive digital radio stations. The control device 14 is in addition also connected to a display device 18 of the motor vehicle 10 and is designed to control the display device 18 to display various digital radio stations A, B, C.

In FIG. 2, the motor vehicle 10 is shown in a further schematic illustration, wherein an area 20 surrounding the motor vehicle 10 is shown. A method for operating the radio system 12 is explained in more detail below.

By means of the control device 14, the area 20 surrounding the motor vehicle 10 is specified first. Here, the extent or size of the area 20 is set by the control device 14 the larger, the faster the motor vehicle 10 is traveling. If a navigation route 22 to a destination 24 of the motor vehicle 10 is specified, the area 20 will be defined such that the area 20 covers at least part of the navigation route 22 or the entire navigation route 22. If no navigation route 22 of the motor vehicle 10 is known, the control device 14 is designed to determine an anticipated route depending on the time of day and depending on the day of the week and taking into account routes which were previously traveled by the motor vehicle 10 and to specify the area 20 in such a way that the area 20 covers at least part of the anticipated route. In other words, the area 20 is thus determined as a function of an estimated direction of travel of the motor vehicle 10.

The size and shape of the area 20 can in addition be predefined as a function of a road type currently being traveled by the motor vehicle 10. If the motor vehicle 10 currently travels on a freeway, for example, the area 20 tends to be elongated in the direction of travel since freeways typically have relatively few accesses and exits. If the motor vehicle 10 travels instead on a highway, for example, from which many roads lead off or join the highway, the area 20 will preferably be predefined as relatively long and relatively wide, for example, circular, so that any instances of turning off onto roads branching off from the highway can also be taken into account.

As soon as the area 20 surrounding the motor vehicle 10 has been specified by means of the control device 14, it is determined which digital radio stations within this area 20 can be received error-free by means of the receiving device 16 of the radio system 12. A file, for example, in the form of a digital receiver card, is preferably stored on-board where the file holds information as to which digital radio stations can be received error-free depending on the location. Using these files, the control unit 14 determines which digital radio stations in the given area 20 can be received error-free.

In this respect, it can be provided that the file is updated within specified time intervals, for example, weekly, monthly or the like. The radio system 12 is in this case designed to establish a wireless connection 26 with an off-board server 28 in order to update the said file. A corresponding file, for example, in the form of a digital receiver card, can be provided on the off-board server 28, said file holding information as to which digital radio stations can be received error-free depending on the location. Due to the continuous on-board updating of the file in which the information is held as to which digital radio stations can be received error-free depending on the location, it is, for example, possible to react easily to weather-related fluctuations in the reception of the digital radio station. It is also possible to react when, for example, there is a change in the distribution of transmitting stations by means of which the digital radio stations are broadcast.

In addition, it is also possible that further motor vehicles not shown here continuously send data to the off-board server 28 by means of which the relevant location-dependent reception qualities of the digital radio stations are described. In this respect, it is possible for the motor vehicle 10 either to update by a car-to-car communication the file stored on board or to alternatively also—as already mentioned—carry out an update of the file by establishing the wireless connection 26 with the off-board server 28.

For example, a selection menu can also be provided by means of the display device 18 by means of which selection menu the driver of the motor vehicle 10 can specify what uninterrupted minimum reception duration or uninterrupted minimum playback duration of the digital radio stations he wants. Corresponding to this input, the control device 14 can on the one hand set the size of the area 20 being monitored with regard to the quality of reception of the digital radio stations, and also filter those digital radio stations which are actually presented for selection by means of the display device 18. In addition or alternatively, it is also possible that the driver can, for example, select from a corresponding selection menu the option that he would prefer to have a particularly large number of digital radio stations displayed. If he selects a particularly large number of digital radio stations for display, it can be provided that the error-free minimum playback duration is automatically reduced for each digital radio station. In other words, the driver can himself choose whether he wants a particularly long error-free playback of the respective digital radio stations to be displayed to him, or instead to have more digital radio stations displayed, wherein in this case, however, there is a risk of the continuous error-free playback of these digital radio stations turning out to be relatively short.

By means of the method described for operating the radio system 12 and by means of the radio system 12 itself, it can thus be guaranteed that a vehicle occupant is not negatively affected by a constant switching back and forth between an active digital radio reception and muting because digital radio content cannot currently be played.

The invention claimed is:

1. A method for operating a radio system of a motor vehicle, the method comprising:

specifying an area surrounding the motor vehicle that moves with the motor vehicle at a speed of the motor vehicle, wherein a size of the area is set based on the speed the motor vehicle is traveling, or the size and a shape of the area are set based on a road type currently being traveled by the motor vehicle, or the size and the shape of the area are set based on a predefined uninterrupted minimum reception duration for digital radio stations;

determining a digital radio station is received error-free within the area using a receiving device of the radio system; and displaying the digital radio station.

2. The method according to claim 1, wherein the determining further comprises:

determining the digital radio station is received error-free within the area based on a file, wherein the file specifies digital radio stations that is received error-free based on a location, wherein the file comprises a digital receiver card.

3. The method according to claim 2, wherein the file is updated at predefined intervals based on data provided by another motor vehicle regarding a location-dependent reception quality of the digital radio stations.

4. The method according to claim 1, further comprising:

specifying a navigation route for the motor vehicle;

wherein the specifying the area surrounding the motor vehicle further comprises:

specifying the area surrounding the motor vehicle to cover at least a portion of the navigation route for the motor vehicle.

5. The method according to claim 1, further comprising:

in response to a navigation route of the motor vehicle being unknown, determining an anticipated route of the motor vehicle, wherein the determining the anticipated route of the motor vehicle is based on a time of day or a day of week and a route previously traveled by the motor vehicle, wherein the area is set to cover at least a portion of the anticipated route.

6. The method of claim 1, the moving the area surrounding the motor vehicle further comprising:

moving the area surrounding the motor vehicle such that a position of the motor vehicle within the area is constant.

7. The method of claim 1, the specifying further comprising:

specifying the area surrounding the motor vehicle based on the speed the motor vehicle is traveling.

8. The method of claim 1, the specifying further comprising:

specifying the area surrounding the motor vehicle based on the road type currently being traveled by the motor vehicle.

9. A radio system for a motor vehicle, the radio system comprising:

a control device configured to:

specify an area surrounding the motor vehicle that moves with the motor vehicle at a speed of the motor vehicle, wherein a size of the area is set based on the speed the motor vehicle is traveling, or the size and a shape of the area are set based on a road type currently being traveled by the motor vehicle, or the size and the shape of the area are set based on a predefined uninterrupted minimum reception duration for digital radio stations;

determine a digital radio station that is received error-free within the area using a receiving device of the radio system; and display the digital radio station.

10. The radio system according to claim 9, the control device further configured to:

determine the digital radio station is received error-free within the area based on a file, wherein the file specifies digital radio stations that can be received error-free based on a location, wherein the file comprises a digital receiver card.

11. The radio system according to claim 10, wherein the file is updated at predefined intervals based on data provided by another motor vehicle regarding a location-dependent reception quality of the digital radio stations.

12. The radio system according to claim 9, the control device further configured to:

specify a navigation route for the motor vehicle; and specifying the area surrounding the motor vehicle to cover at least a portion of the navigation route for the motor vehicle.

13. The radio system according to claim 9, the control device further configured to:

in response to a navigation route of the motor vehicle being unknown, determine an anticipated route of the motor vehicle based on a time of day or a day of week and a route previously traveled by the motor vehicle, wherein the area is set to cover at least a portion of the anticipated route.

14. The radio system according to claim 9, the control device further configured to:

move the area surrounding the motor vehicle at the speed the motor vehicle is traveling.

15. The radio system according to claim 14, the control device further configured to:

move the area surrounding the motor vehicle such that a position of the motor vehicle within the area is constant.

16. The radio system according to claim 9, the control device further configured to:

specify the area surrounding the motor based on the speed the motor vehicle is traveling.

17. The radio system according to claim 9, the control device further configured to:

specify the area surrounding the motor vehicle based on the road type currently being traveled by the motor vehicle.

* * * * *